US009795188B2

(12) United States Patent
Sargissian-Sarian

(10) Patent No.: US 9,795,188 B2
(45) Date of Patent: Oct. 24, 2017

(54) LACE SECUREMENT DEVICE

(71) Applicant: Sophia Sargissian-Sarian, Burbank, CA (US)

(72) Inventor: Sophia Sargissian-Sarian, Burbank, CA (US)

( * ) Notice: Subject to any disclaimer, the term of this patent is extended or adjusted under 35 U.S.C. 154(b) by 313 days.

(21) Appl. No.: 14/568,902

(22) Filed: Dec. 12, 2014

(65) Prior Publication Data

US 2016/0166008 A1 Jun. 16, 2016

(51) Int. Cl.

| | |
|---|---|
| ***A43C 7/04*** | (2006.01) |
| ***A43C 7/00*** | (2006.01) |
| *G09F 3/16* | (2006.01) |

(52) U.S. Cl.

CPC ..... *A43C 7/005* (2013.01); *G09F 3/16* (2013.01)

(58) Field of Classification Search

CPC ... F16B 7/0433; B65D 63/10; B65D 63/1018; B65D 63/1027; F16L 3/233; F16L 3/11; F16L 3/23; A43C 7/005; A43C 7/04; A43C 7/08; A45D 8/14; A45D 8/20; A45D 8/16; A45D 8/06; Y10T 24/3705; Y10T 24/3708; Y10T 24/3716; Y10T 24/3718; Y10T 24/3721; G09F 3/16; G09F 3/0295

USPC ..... 40/636, 666; 63/43; 24/499

See application file for complete search history.

(56) References Cited

U.S. PATENT DOCUMENTS

| | | | | |
|---|---|---|---|---|
| 1,040,918 | A | 10/1912 | Fischer | |
| 1,221,656 | A | 4/1917 | Benson | |
| 1,439,241 | A | 12/1922 | Hoppe | |
| 1,549,170 | A | 8/1925 | Waldron | |
| 1,913,102 | A * | 6/1933 | Berger | A43C 7/00 24/115 H |
| 1,941,654 | A | 1/1934 | Bertsch | |
| 2,877,526 | A | 3/1959 | Simpson | |
| D626,691 | S | 11/2010 | Hsu | |
| 2010/0051046 | A1 * | 3/2010 | Stevenson | A45D 8/14 132/275 |

* cited by examiner

*Primary Examiner* — Jack W Lavinder

(57) ABSTRACT

A lace securement device prevents laces on a shoe from coming untied. The device includes a head, a first arm coupled to and extending from an edge of the head, and a second arm coupled to and extending from the edge of the head. The second arm is couplable to the first arm in spaced relationship to the head defining a closed position forming a loop extending from the edge of the head for receiving laces on a shoe therethrough. The first arm and the second arm are positioned adjacently for abutting and securing the laces such that the loop prevents the laces from coming untied.

9 Claims, 3 Drawing Sheets

LACE SECUREMENT DEVICE

BACKGROUND OF THE DISCLOSURE

Field of the Disclosure

The disclosure relates to securement devices and more particularly pertains to a new securement device for preventing laces on a shoe from coming untied.

SUMMARY OF THE DISCLOSURE

An embodiment of the disclosure meets the needs presented above by generally comprising a head, a first arm coupled to and extending from an edge of the head, and a second arm coupled to and extending from the edge of the head. The second arm is couplable to the first arm in spaced relationship to the head defining a closed position forming a loop extending from the edge of the head for receiving laces on a shoe therethrough. The first arm and the second arm are positioned adjacently for abutting and securing the laces such that the loop prevents the laces from coming untied.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
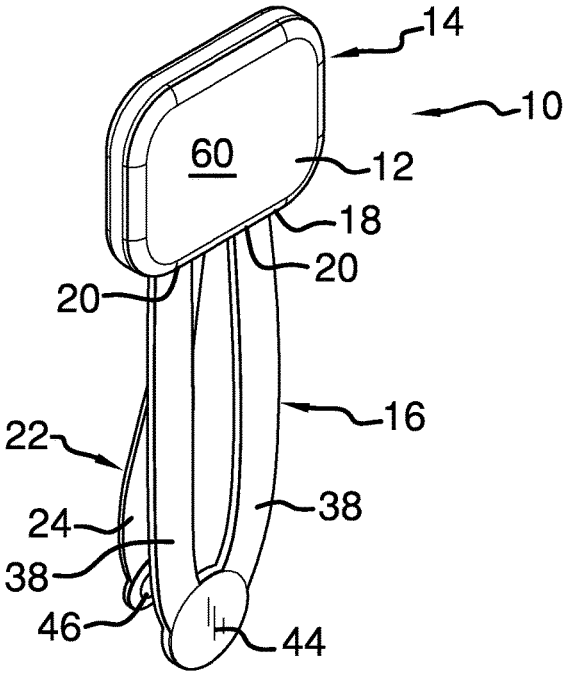
FIG. 1 is a top front side perspective view of a lace securement device according to an embodiment of the disclosure.
Figure 2:
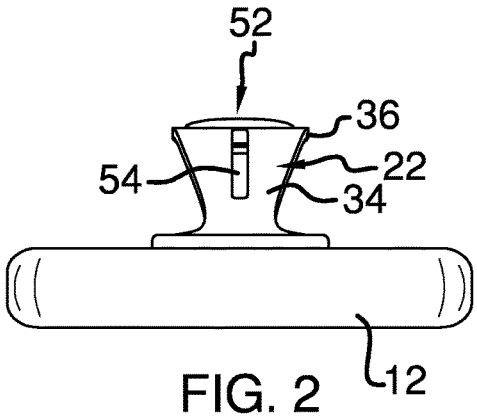
FIG. 2 is a top view of an embodiment of the disclosure.
Figure 3:
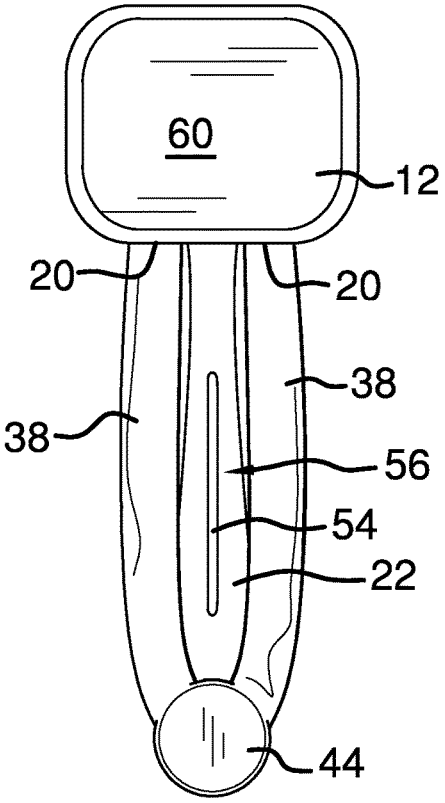
FIG. 3 is a front view of an embodiment of the disclosure.
Figure 4:
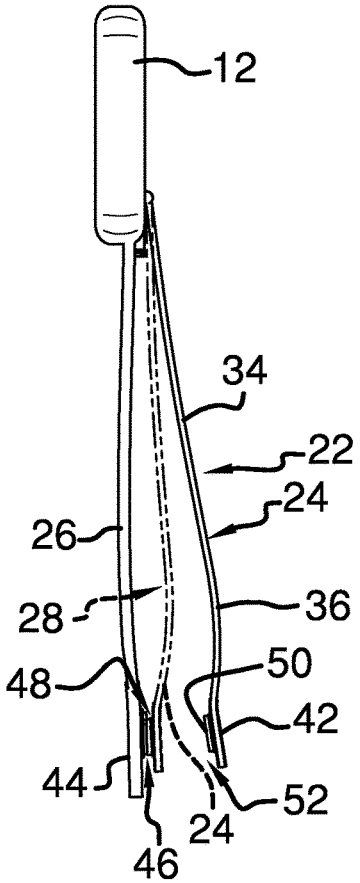
FIG. 4 is a side view of an embodiment of the disclosure.
Figure 5:
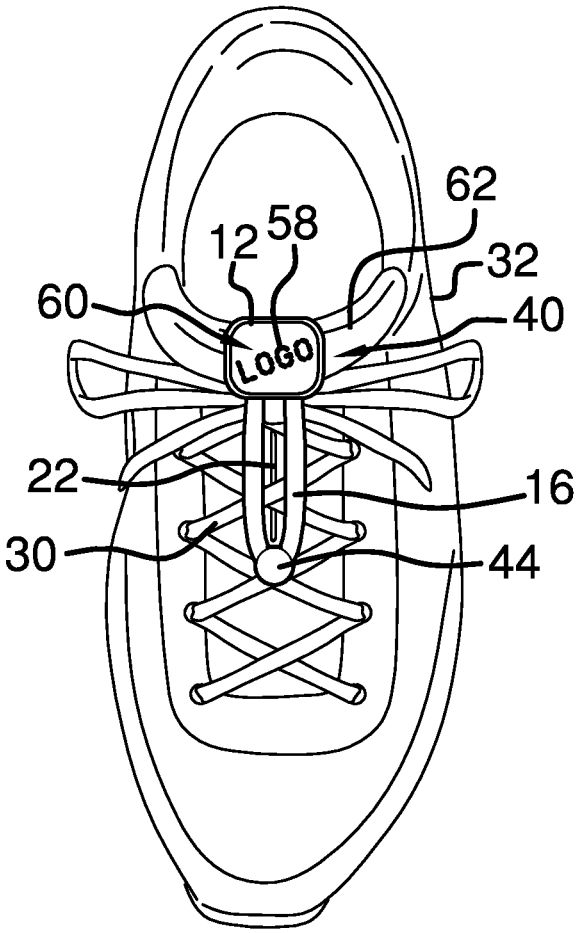
FIG. 5 is a top view of an embodiment of the disclosure in use.

With reference now to the drawings, and in particular to FIGS. 1 through 5 thereof, a new securement device embodying the principles and concepts of an embodiment of the disclosure and generally designated by the reference numeral 10 will be described.

As best illustrated in FIGS. 1 through 5, the lace securement device 10 generally comprises a head 12 having a decorative shape 14. A first arm 16 is coupled to and extends from an edge 18 of the head 12. The first arm 16 is substantially U-shaped having opposite ends 20 coupled to the edge 18 of the head 12. A second arm 22 is coupled to and extends from the edge 18 of the head 12. The second arm 22 is a single elongated member 24 extending from the edge 18 of the head 12 between the opposite ends 20 of the first arm 16. The second arm 22 is couplable to the first arm 16 in spaced relationship to the head 12 defining a closed position 26 wherein the first arm 16 and the second arm 22 form a loop 28 extending from the edge 18 of the head 12. The loop 28 is configured for receiving laces 30 on a shoe 32 therethrough. The second arm 22 has a straight section 34 extending rearwardly and away from the edge 18 of the head 12 and an arcuate section 36 extending from the straight section 34. The arcuate section 36 of the second arm 22 is concave facing the first arm 16 wherein the arcuate section 36 extends forwardly and downwardly relative to the edge 18 of the head 12. Each of a pair of side sections 38 of the first arm 16 is concave facing the second arm 22. The first arm 16 and the second arm 22 are positioned adjacently such that the loop 28 is configured for abutting and securing the laces 30 such that the loop 28 prevents the laces 30 from coming untied and the head 12 is displayed at a top 40 of the laces 30 when the laces 30 are tied.

A distal end 42 of the second arm 22 overlaps a junction 44 of the side sections 38 of the first arm 16. A coupler 46 has a first section 48 coupled to the first arm 16 and a second section 50 coupled to the second arm 22. The first section 48 of the coupler 46 is complementary to the second section 50 wherein the coupler 46 secures the first arm 16 to the second arm 22 when the first section 48 of the coupler 46 engages the second section 50 of the coupler 46. The coupler 46 may be a snap 52 or the like. An elongated slot 54 extends longitudinally along a medial portion 56 of the second arm 22. Indicia 58 may be positioned on a front face 60 of the head 12 to enhance the decoration provided by the device 10 while used.

In use, the first arm 16 and second arm 22 are disengaged from each other, the second arm 22 is slid between the laces 30 and a tongue 62 of the shoe 32. The coupler 46 is engaged in a gap 64 in the laces 30 securing the device 10 to the shoe 32 engaging the laces 30 such that the laces 30 are prevented from coming untied.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lace securement device comprising:

a head;

a first arm coupled to and extending from an edge of said head;

a second arm coupled to and extending from said edge of said head, said second arm being couplable to said first arm in spaced relationship to said head defining a closed position wherein said first arm and said second arm form a loop extending from said edge of said head such that said loop is configured for receiving laces on a shoe therethrough; and wherein said first arm and said second arm are positioned adjacently such that said loop is configured for abutting and securing the laces such that said loop prevents the laces from coming untied;

an elongated slot extending longitudinally along a medial portion of said second arm; and said second arm having a straight section extending rearwardly and away from said edge of said head and an arcuate section extend from said straight section, said arcuate section of said second arm being concave facing said first arm wherein said arcuate section extends forwardly and downwardly relative to said edge of said head.

2. The device of claim 1, further comprising said first arm being substantially U-shaped having opposite ends coupled to said edge of said head.

3. The device of claim 2, further comprising said second arm being a single elongated member extending from said edge of said head.

4. The device of claim 1, further comprising said head having a decorative shape.

5. The device of claim 1, further comprising side sections of said first arm each being concave facing said second arm.

6. The device of claim 1, further comprising indicia being positioned on a front face of said head.

7. A lace securement device comprising:

a head;

a first arm coupled to and extending from an edge of said head, said first arm being substantially U-shaped having opposite ends coupled to said edge of said head;

a second arm coupled to and extending from said edge of said head, said second arm being a single elongated member extending from said edge of said head, said second arm being couplable to said first arm in spaced relationship to said head defining a closed position wherein said first arm and said second arm form a loop extending from said edge of said head such that said loop is configured for receiving laces on a shoe therethrough;

wherein said first arm and said second arm are positioned adjacently such that said loop is configured for abutting and securing the laces such that said loop prevents the laces from coming untied;

a distal end of said second arm overlapping a junction of side sections of said first arm; and a coupler having a first section coupled to said first arm and a second section coupled to said second arm, said first section of said coupler being complementary to said second section wherein said coupler secures said first arm to said second arm when said first section of said coupler engages said second section of said coupler.

8. The device of claim 7, further comprising said coupler being a snap.

9. A lace securement device comprising:

a head, said head having a decorative shape;

a first arm coupled to and extending from an edge of said head, said first arm being substantially U-shaped having opposite ends coupled to said edge of said head;

a second arm coupled to and extending from said edge of said head, said second arm being a single elongated member extending from said edge of said head, said second arm being couplable to said first arm in spaced relationship to said head defining a closed position wherein said first arm and said second arm form a loop extending from said edge of said head such that said loop is configured for receiving laces on a shoe therethrough, said second arm having a straight section extending rearwardly and away from said edge of said head and an arcuate section extend from said straight section, said arcuate section of said second arm being concave facing said first arm wherein said arcuate section extends forwardly and downwardly relative to said edge of said head, each of said side sections of said first arm being concave facing said second arm;

wherein said first arm and said second arm are positioned adjacently such that said loop is configured for abutting and securing the laces such that said loop prevents the laces from coming untied;

a distal end of said second arm overlapping a junction of side sections of said first arm;

a coupler having a first section coupled to said first arm and a second section coupled to said second arm, said first section of said coupler being complementary to said second section wherein said coupler secures said first arm to said second arm when said first section of said coupler engages said second section of said coupler, said coupler being a snap;

an elongated slot extending longitudinally along a medial portion of said second arm; and indicia being positioned on a front face of said head.

* * * * *